US009976531B2

(12) United States Patent
Schmieder et al.

(10) Patent No.: US 9,976,531 B2
(45) Date of Patent: May 22, 2018

(54) VALVE FOR DOSING A FLOWING MEDIUM

(75) Inventors: Dietmar Schmieder, Markgroeningen (DE); Thomas Sebastian, Erdmannhausen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 431 days.

(21) Appl. No.: 14/239,507

(22) PCT Filed: Jun. 26, 2012

(86) PCT No.: PCT/EP2012/062303

§ 371 (c)(1),
(2), (4) Date: May 22, 2014

(87) PCT Pub. No.: WO2013/023825

PCT Pub. Date: Feb. 21, 2013

(65) Prior Publication Data

US 2014/0299805 A1 Oct. 9, 2014

(30) Foreign Application Priority Data

Aug. 18, 2011 (DE) ..... 10 2011 081 176

(51) Int. Cl.
*F02M 63/00* (2006.01)
*F02M 51/06* (2006.01)
*F02M 61/16* (2006.01)

(52) U.S. Cl.
CPC .... *F02M 63/0005* (2013.01); *F02M 51/0603* (2013.01); *F02M 61/167* (2013.01);
(Continued)

(58) Field of Classification Search
CPC ..... F02M 63/0005; F02M 51/0603; F02M 61/167; F02M 61/168; F02M 2200/00;
(Continued)

(56) References Cited

U.S. PATENT DOCUMENTS 3,932,988 A * 1/1976 Beaufrere ..... F01D 5/046 239/214.17
6,499,676 B1 * 12/2002 Erdogan ..... F02M 55/008 123/472

(Continued)

FOREIGN PATENT DOCUMENTS

CN 1380939 A 11/2002
DE 19705227 A1 8/1998

(Continued)

OTHER PUBLICATIONS

Translation of DE202006002663.*
International Search Report for PCT/EP2012/062303, dated Oct. 9, 2012.

*Primary Examiner* — Kevin Murphy
*Assistant Examiner* — Kelsey Cary
(74) *Attorney, Agent, or Firm* — Norton Rose Fulbright US LLP; Gerard Messina

(57) ABSTRACT

A valve for metering a flowing, e.g. gaseous or liquid, medium, in particular a fuel injection valve for internal combustion engines, is described, which valve comprises a valve housing having an inflow for the medium, a valve body having a metering opening for the medium, a join present between the valve housing and valve body, and a seal sealing the join. In order to ensure a seal that is reliable and not susceptible to cracking, in which context the material of the valve housing and valve body can be selected without restriction, the seal has a clamping ring, covering the join, that sits with a press fit on end portions, facing toward one another at the join, of the valve housing and valve body.

19 Claims, 2 Drawing Sheets

(52) U.S. Cl.
CPC ..... *F02M 61/168* (2013.01); *F02M 2200/00* (2013.01); *F02M 2200/16* (2013.01); *F02M 2200/803* (2013.01); *F02M 2200/8053* (2013.01)

(58) Field of Classification Search
CPC ..... F02M 2200/03; F02M 2200/16; F02M 2200/25; F02M 2200/26; F02M 2200/80; F02M 2200/803; F02M 2200/8053
USPC ..... 251/367
See application file for complete search history.

(56) References Cited

U.S. PATENT DOCUMENTS

| | | | | |
|---|---|---|---|---|
| 6,688,423 | B1 * | 2/2004 | Beatty | B62D 5/062 138/26 |
| 2007/0221745 | A1 * | 9/2007 | Stoecklein | F02M 51/0603 239/88 |
| 2009/0050114 | A1 * | 2/2009 | Heinz | F02M 51/005 123/494 |
| 2010/0001101 | A1 * | 1/2010 | Leuteritz | B05B 1/083 239/533.3 |

FOREIGN PATENT DOCUMENTS

| | | | |
|---|---|---|---|
| DE | 202006002663 | U1 | 4/2006 |
| DE | 102006002663 | | 8/2007 |
| DE | 102006019308 | | 10/2007 |
| DE | 102007028490 | | 12/2008 |
| EP | 1820957 | A2 | 8/2007 |
| JP | H08226364 | A | 9/1996 |
| JP | H10159675 | A | 6/1998 |
| JP | 2001221122 | A | 8/2001 |
| JP | 2003528254 | A | 9/2003 |
| JP | 2005504922 | A | 2/2005 |
| JP | 2006046346 | A | 2/2006 |
| JP | 2006152907 | A | 6/2006 |
| JP | 2009058067 | A | 3/2009 |
| WO | WO01/79688 | | 10/2001 |
| WO | WO2006/106021 | | 10/2006 |
| WO | 2010091759 | A1 | 8/2010 |

* cited by examiner

VALVE FOR DOSING A FLOWING MEDIUM

FIELD OF THE INVENTION

The invention proceeds from a valve for metering a flowing, e.g. gaseous or liquid, medium, in particular a fuel injection valve for internal combustion engines.

BACKGROUND INFORMATION

A known fuel injection valve (German Published Patent Application No. 10 2007 028 490) has a hollow-cylindrical housing having an inflow end and a spray-discharge end. The inflow end is closed off by a cover carrying an inflow fitting; and a hollow-cylindrical valve body or nozzle body, which projects in part out of the housing, is inserted into the spray-discharge end. A spray-discharge opening, and a valve seat surrounding the spray-discharge opening on the outlet side, are embodied at that end of the valve body which remote from the housing. The spray-discharge end of the valve housing surrounds the valve body, and the annular join between the valve housing and valve body is sealed in liquid-tight fashion by way of a weld seam that connects the valve housing and valve body to one another, so that a fuel under a system pressure of, for example, 200 bar in the valve housing cannot emerge from the join.

SUMMARY

The valve according to the present invention has the advantage that the clamping ring covering the join with a press fit onto the valve housing and body produces a sealing of the join between the valve housing and valve body which, compared with a weld seam, is secure and not susceptible to cracking The press fit of the clamping ring is produced preferably by heat shrinking For this, the clamping ring is heated, for example inductively and to the highest possible temperature; and the clamping ring, its inside diameter thereby enlarged, is slid or pressed onto the end portions of the valve housing and valve body so as to cover the join. The clamping ring shrinks upon cooling, and pulls the valve body and valve housing axially together, thereby bringing about a nonpositive engagement between the valve housing and valve body, and radial and axial sealing of the join. Alternatively, the press fit can also be produced by mechanically pressing on the clamping ring that has been slid with an overdimension onto the end portions of the valve housing and valve body. In contrast to sealing by way of a weld seam, the material of the valve housing and valve body can be selected without restriction, since the obligation to use a very easily weldable material in order to achieve a mechanically stable, pressure- and break-resistant weld seam is eliminated. The valve housing and valve body can thus be manufactured from an economical material, and manufacturing costs are lowered. Unlike with welding, where welding distortion can occur between the valve housing and valve body, reliable and good placement positioning of the two parts is achieved. In contrast to the case with welding of the valve housing and valve body, reliable sealing of the join can be ensured, despite high pressures in the valve housing, even when the valve body has a large outside diameter. A large outside diameter in turn creates the possibility of eccentric fluid guidance, which is advantageous for certain design embodiments of the valve, in the valve housing with respect to the central metering opening in the valve body. In order to limit the energy used to heat the clamping ring, the clamping ring is designed with the smallest possible volume.

According to an advantageous embodiment of the invention, the end portions of the valve housing and valve body in the coverage region of the clamping ring are equipped with radial sealing edges spaced apart from one another that are formed, in a simple manner in terms of production engineering, by the tooth flanks of a tooth set. As a result of the hooking, associated with production of the press fit of the clamping ring, of the clamping ring into the sealing edges, a positive engagement is additionally brought about and the radial and axial sealing of the join is further improved.

According to an advantageous embodiment of the invention, the end portions of the valve housing and valve body are butted against one another at the join, and have an identical outside diameter. The valve body and valve housing abut against each other in the join with an annular first stop surface embodied on the valve body and an annular second stop surface embodied on the valve housing, which is preferably disposed set back with respect to the end surface of the valve housing. The first stop surface has an inner circumferential edge that demarcates a central recess, impinged upon by medium, in the valve body; and the second stop surface has a projection region protruding beyond the inner circumferential edge. The recess encloses an obtuse angle with the annular recess bottom, and is embodied to be flat or concavely curved. The recess reduces the stiffness of the valve body at the join, and the fluid pressure existing in the recess additionally presses the valve body radially against the clamping ring, thereby enhancing positive engagement and sealing at the join.

This effect is even further enhanced by the fact that, in accordance with a further embodiment of the invention, there is disposed on the valve housing, in the projection region of the second abutment surface, a groove that is open toward the recess and that preferably has a groove flank extending toward the inner circumferential edge of the first abutment surface on the valve body at an obtuse angle with respect to the groove bottom. This groove also results in a reduction in stiffness in the end portion of the valve housing, so that the fluid pressure existing in the recess and groove also presses the valve housing radially against the clamping ring.

According to further embodiments of the invention, the radial and axial sealing of the join can be additionally improved by a variety of features. For example, a sealing ring covering the join and made of an elastomer, e.g. silicone, which presses radially onto the end portions of the valve housing and valve body, can additionally be placed into the clamping ring; or at least a part of that region of the end portions of the valve housing and valve body which is covered by the clamping ring can be coated with elastic sealing material, e.g. silicone; or a sealing ring made of an elastomer, e.g. silicone, can be disposed between the mutually abutting contact surfaces of the valve housing and valve body; or at least one of the two abutment surfaces on the valve housing and valve body can be coated with a sealing material, e.g. silicone. Welding of the clamping ring on the one hand to the valve body and on the other hand to the valve housing can moreover be additionally performed. In this case the two weld seams perform only a sealing function, since the axial forces of the fluid pressure are received by the clamping ring. Because the weld seams as a result do not need to have a high level of mechanical stability, a material that is less well suited for welding can also be used for the valve housing, valve body, and clamping ring.

A material that is as hard as possible and has high strength, e.g. 1.4035 hardened steel, is preferably used for the valve housing and valve body; and a material having high strength and slightly lower hardness, e.g. 1.4035 hardened and annealed steel, is used for the clamping ring.

DETAILED DESCRIPTION

Figure 1:
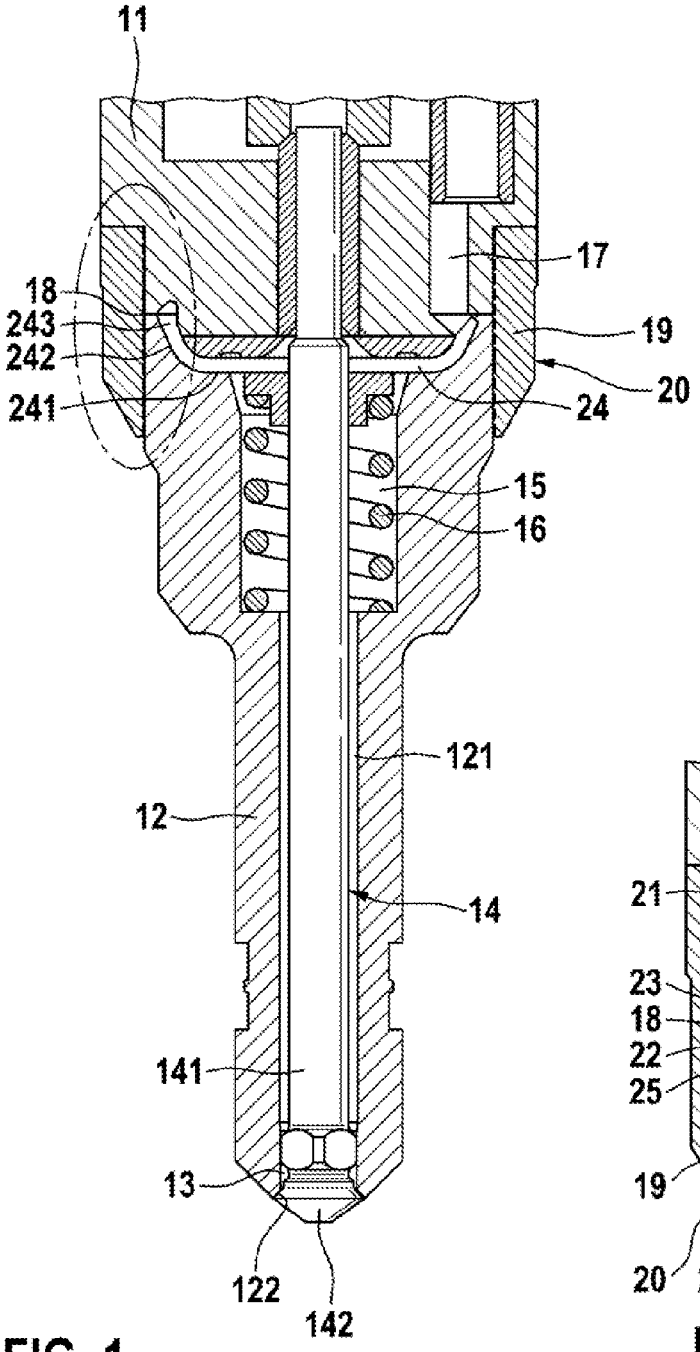
FIG. 1 shows portions of a longitudinal section of a valve for metering a liquid or gaseous medium.

The valve, depicted in longitudinal section in FIG. 1, for metering a flowing medium, i.e. a liquid or gaseous medium, is used preferably as an injection valve for injecting fuel into the combustion cylinder or air intake section of an internal combustion engine, but can also be utilized as a dispensing valve for injecting an aqueous solution, for example a urea-water solution, into the exhaust section of an internal combustion engine. The valve has a valve housing 11, one of whose end faces is closed off by a valve body 12. A metering opening 13 that is controlled, i.e. closed or opened, by an outwardly opening valve member 14 in conjunction with a valve seat 122 embodied on valve body 12 is embodied at that end of a through orifice 121 extending centrally in valve body 12 which is remote from the housing. Valve member 14, having a valve needle 141 and a closure head 142 disposed at the end of valve needle 141, is actuated in known fashion by an actuator (not depicted here), e.g. a piezoelectric actuator, against the return force of a valve closing spring 16 bracing against valve needle 141 and against valve body 12. An axially extending inflow 17 for the medium is provided eccentrically in valve housing 11; through the inflow the medium travels into a cavity 15 that is embodied in valve body coaxially with through orifice 121 and receives valve closing spring 141, and from there via through orifice 121, which guides valve needle 141, to a metering opening 13 closed by closure head 142.

A join 18, at which the mutually facing end portions of valve housing 11 and 12, which have the same outside diameter, abut against one another, is present between valve housing 11 and valve body 12. Join 18 is sealed by a seal 20. Seal 20 has, according to the present invention, a clamping ring 19 that covers join 18 and rests with a press fit on the end portions of valve housing 11 and valve body 12. Clamping ring 19 is made from a material having high strength and a hardness slightly less than the hardness of the material of valve housing 11 and valve body 12. Clamping ring 19 is made, for example, of 1.4035 hardened and annealed steel, and valve housing 11 and valve 12 of 1.4035 hardened steel.

The press fit is preferably produced by heat-shrinking clamping ring 18 onto the end portions of valve housing 11 and valve body 12. For this, clamping ring 19 is heated preferably, for example, inductively to the highest possible temperature, and clamping ring 19, its inside diameter enlarged by the heating, is slid or pressed over join 18 onto the end portions of valve housing 11 and of valve body 12. In order to shorten its heating process and in order to save energy, clamping ring 19 has a volume that is as small as possible. Clamping ring 19 shrinks upon cooling. Valve body 12 and valve housing 11 are thereby pulled axially together at join 18, and a nonpositive engagement and a radial and axial seal are produced between valve body 12 and valve housing 11.

Figure 2:
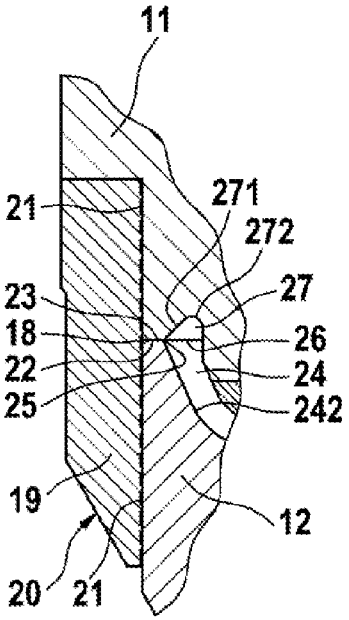
FIG. 2 shows an enlarged portion of the valve of FIG. 1.

As is apparent from the portion of the valve depicted in enlarged fashion in FIG. 2, the end portions of valve housing 11 and valve body 12 are additionally equipped, in the coverage region of clamping ring 19, with radial sealing edges spaced apart from one another that are formed, in the simplest case, by the tooth flanks of a tooth set 21. The press fit causes clamping ring 19 to additionally hook into the sealing edges of tooth set 21, with the result that an additional positive engagement and an enhanced sealing action are achieved.

The radial sealing and the positive engagement are additionally reinforced by the fluid pressure existing in the interior of valve body 12 and valve housing 11, by the fact that a reduction in the stiffness of valve body 12 and valve housing 11 is performed. For this, an annular first abutment surface 22 is embodied on valve body 12, and an annular second abutment surface 23 on valve housing 11. First abutment surface 22 and second abutment surface 23 abut against one another in join 18. First abutment surface 22 has an inner circumferential edge 25 demarcated by a central recess 24 in valve body 12, and second abutment surface 23, which is disposed on valve housing 11 with a setback with respect to the end face of valve housing 11, has a projection region 26 that protrudes beyond inner circumferential edge 25 and is thus located over recess opening 243. Recess 24 has an annular recess bottom 241 through which valve needle 141 of valve member 14 passes, a recess wall 242, and a recess opening 243 surrounded by recess wall 242. Inflow 17 for the medium opens into recess opening 243, so that recess 24 is impinged upon by medium under system pressure. Recess wall 242 preferably encloses an obtuse angle with recess bottom 241, and in the exemplifying embodiment is embodied with a concave curvature (FIG. 2). A flat or planar embodiment of recess wall 242 is possible. A groove 27 open toward recess 24 is disposed in projection region 26 of second abutment surface 23 on valve housing 11. groove 27 has a groove flank 271 that extends toward inner circumferential edge 25 of first abutment surface 22 on valve body 12, preferably at an obtuse angle with respect to groove bottom 272 (FIG. 2). The system pressure of the medium acting on recess wall 242 and on groove flank 271 additionally presses the end portions of valve body 12 and valve housing 11 radially against the shrunk-on clamping ring 19, and thus reinforces the radial sealing and positive engagement between valve housing 11 and valve body 12 at join 18.

In the portions depicted in FIGS. 3 to 7 of modified exemplifying embodiments of the valve, seal 20 at join 18 between valve housing 11 and valve body 12 is also supplemented with further design features in addition to the shrunk-on clamping ring 19.

Figure 3:
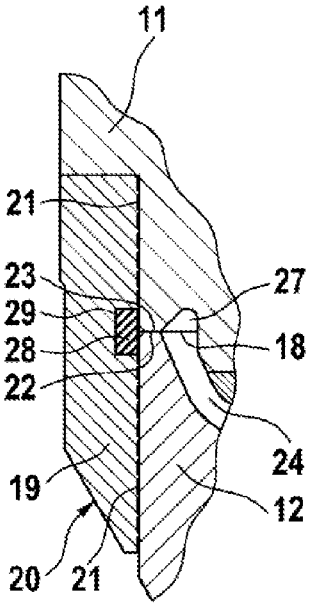
FIGS. 3 to 7 each shows what is depicted in FIG. 2, in accordance with further exemplifying embodiments.

In the exemplifying embodiment according to FIG. 3, seal 20 also has, in addition to clamping ring 19, a sealing ring 28 that is made of an elastomer, e.g. silicone, and axially covers join 18, and that is placed into clamping ring 19 and presses radially onto the end portions of valve housing 11 and valve body 12. Sealing ring 28 is received in a groove 29, recessed into the inner annular wall of clamping ring 19, that is preferably disposed symmetrically with respect to join 18.

Figure 4:
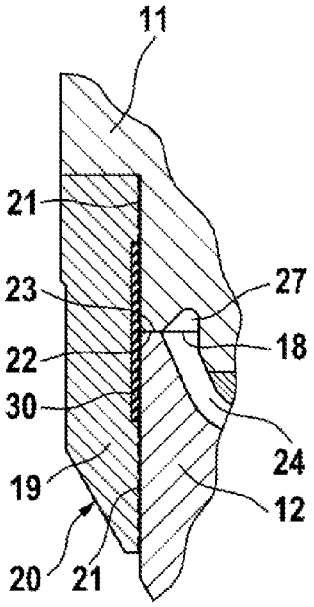

In the exemplifying embodiment according to FIG. 4, seal 20 also has, in addition to clamping ring 19, a coating 30 that is made of an elastomer, e.g. silicone, and that extends, in that region of the end portions of valve housing 11 and valve body 12 which is covered by clamping ring 19, at least over a part of both the end portion of valve housing 11 and the end portion of valve body 12. The two parts of coating 30 (which are preferably of the same size) are applied onto the end portions of valve housing 11 and valve body 12 before clamping ring 19 is pressed on.

Figure 5:
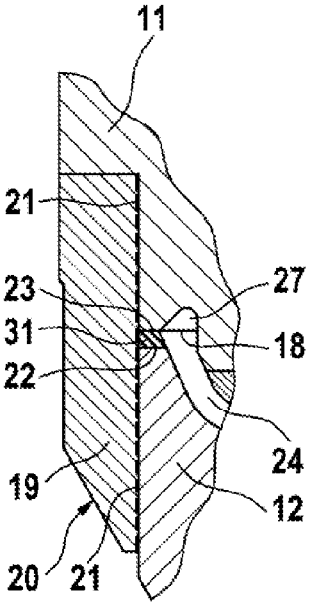

In the exemplifying embodiment according to FIG. 5, seal 20 also has, in addition to clamping ring 19, a sealing ring 31 that is made of an elastomer, e.g. silicone, and that is disposed between abutment surfaces 22, 23 of valve body 12 and valve housing 11.

Figure 6:
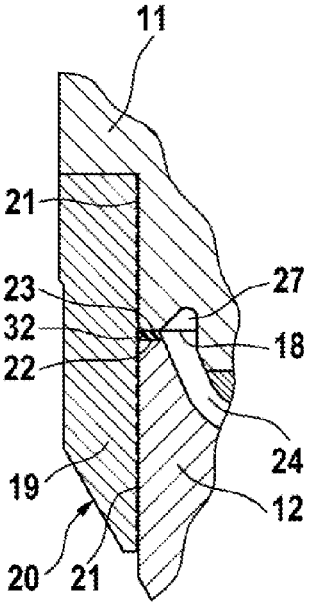

In the exemplifying embodiment according to FIG. 6, seal 20 also has, in addition to clamping ring 19, a coating 32 that is made of an elastomer, e.g. silicone, and is applied onto one of the two abutment surfaces 22, 23, or both, of valve body 12 and valve housing 11.

Figure 7:
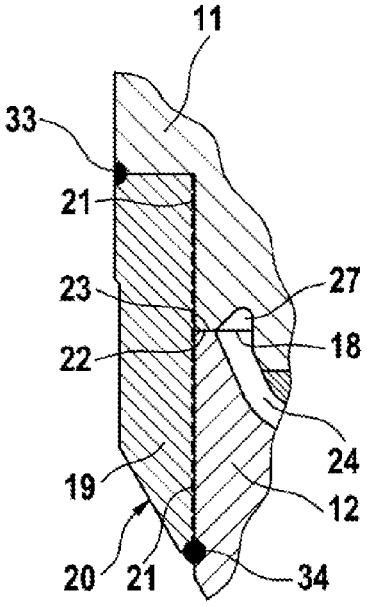

The exemplifying embodiment according to FIG. 7 differs from the exemplifying embodiment according to FIGS. 1 and 2 only in that clamping ring 19, shrunk onto the end portions of valve housing 11 and valve body 12, is also welded at its two end faces on the one hand to valve housing 11 and on the other hand to valve body 12. The weld seams thereby produced are labeled 33 and 34 in FIG. 7. These weld seams 33, 34 serve exclusively for additional sealing of join 18 and do not receive any axial forces, so that more stringent demands do not need to be made in terms of their mechanical strength, and a material less suitable for welding can also be used for valve housing 11, valve body 12, and clamping ring 19.

Except for the modified seal 20, the exemplifying embodiments of the valves depicted in part in FIGS. 3 to 7 correspond to the exemplifying embodiment of the valve according to FIGS. 1 and 2, so that identical components are labeled with the same reference characters.

What is claimed is:

1. A valve for metering a flowing medium, comprising:

a valve housing having an inflow for the flowing medium;

a valve body having a metering opening for the flowing medium;

a join present between the valve housing and the valve body;

a seal sealing the join and including a clamping ring, wherein the clamping ring covers the join and sits with a press fit on end portions, facing toward one another at the join, of the valve housing and valve body; wherein:

the valve body and the valve housing abut against each other in the join with an annular first abutment surface embodied on the valve body and an annular second abutment surface embodied on the valve housing, the first abutment surface has an inner circumferential edge that demarcates a central recess, impinged upon by the flowing medium, in the valve body, the second abutment surface has a projection region protruding beyond the inner circumferential edge, a groove that is open toward the recess is disposed on the valve housing in a projection region of the second abutment surface, the groove is impinged upon by the flowing medium, the groove has a groove flank extending toward the inner circumferential edge of the first abutment surface on the valve body at an obtuse angle with respect to a groove bottom, and the end portions of the valve housing and the valve body are butted against one another at the join, and have an identical outside diameter.

2. The valve as recited in claim 1, wherein the flowing medium includes one of a gaseous flowing medium and a liquid flowing medium.

3. The valve as recited in claim 1, wherein the valve is a fuel injection valve for an internal combustion engine.

4. The valve as recited in claim 1, wherein the end portions of the valve housing and the valve body in a coverage region of the clamping ring are equipped with radial sealing edges spaced apart from one another.

5. The valve as recited in claim 4, wherein the radial sealing edges are formed by tooth flanks of a tooth set.

6. The valve as recited in claim 1, wherein:

the recess has an annular recess bottom, a recess wall, and a recess opening surrounded by the recess wall, and the inflow for the flowing medium opens into the recess opening.

7. The valve as recited in claim 6, wherein the recess wall encloses an obtuse angle with the recess bottom and is embodied to be one of flat and concavely curved.

8. The valve as recited in claim 1, wherein the second abutment surface on the valve housing is disposed with a setback with respect to an end face of the valve housing.

9. The valve as recited in claim 1, wherein the seal has a sealing ring axially covering the join and made of an elastomer placed into the clamping ring and pressing radially onto the end portions of the valve housing and the valve body.

10. The valve as recited in claim 9, wherein the elastomer includes silicone.

11. The valve as recited in claim 9, wherein the sealing ring is received in a groove recessed into an inner ring wall of the clamping ring.

12. The valve as recited in claim 1, wherein the seal has a coating made of an elastomer occupying at least a part of that region of the end portions of the valve housing and the valve body covered by the clamping ring.

13. The valve as recited in claim 12, wherein the elastomer includes silicone.

14. The valve as recited in claim 1, wherein the seal has a sealing ring made of an elastomer disposed between the abutting surfaces of the valve body and the valve housing.

15. The valve as recited in claim 14, wherein the elastomer includes silicone.

16. The valve as recited in claim 1, wherein the seal includes a coating made of an elastomer covering at least one of the two abutment surfaces on the valve body and the valve housing.

17. The valve as recited in claim 16, wherein the elastomer includes silicone.

18. The valve as recited in claim 1, wherein the clamping ring is welded at an end on the one hand to the valve housing and on the other hand to the valve body.

19. The valve as recited in claim 1, wherein the press fit is produced by heat-shrinking the clamping ring onto the end portions of the valve housing and the valve body.

* * * * *